US010893763B2

(12) United States Patent
Kitamura et al.

(10) Patent No.: US 10,893,763 B2
(45) Date of Patent: Jan. 19, 2021

(54) PLATE WITH INCLINED SURFACE

(71) Applicant: PORTEARTH CO., LTD., Nara (JP)

(72) Inventors: Wataru Kitamura, Nara (JP); Takuya Oka, Nara (JP)

(73) Assignee: PORTEARTH CO., LTD., Nara (JP)

( * ) Notice: Subject to any disclaimer, the term of this patent is extended or adjusted under 35 U.S.C. 154(b) by 20 days.

(21) Appl. No.: 16/171,828

(22) Filed: Oct. 26, 2018

(65) Prior Publication Data

US 2019/0125109 A1 May 2, 2019

(30) Foreign Application Priority Data

Oct. 31, 2017 (JP) ..... 2017-211413

(51) Int. Cl.
*A47G 19/02* (2006.01)

(52) U.S. Cl.
CPC ..... *A47G 19/02* (2013.01)

(58) Field of Classification Search
CPC ..... A47G 19/02; A47G 19/022
USPC ..... 220/574
See application file for complete search history.

(56) References Cited

U.S. PATENT DOCUMENTS

2006/0286215 A1* 12/2006 Yu ..... A45C 11/20 426/106
2008/0203100 A1* 8/2008 Young ..... A01K 5/0114 220/574

FOREIGN PATENT DOCUMENTS

JP 1980-129079 U 9/1980
JP 3043757 U 5/1997

* cited by examiner

*Primary Examiner* — Stephen J Castellano
(74) *Attorney, Agent, or Firm* — Renner, Otto, Boisselle & Sklar, LLP

(57) ABSTRACT

A conventional plate is problematic in that oily juices from barbequed meat on an upper part of a plate run along linearly cut grooves when the plate is tilted, and thus tend to spill off the plate. In the present invention, thirteen raised parts curved in an outer peripheral direction are formed toward a direction of an outer edge from a middle part of the upper surface of a plate, and thus oily juices from barbequed meat that collect on the plate run along the raised parts curved in the outer peripheral direction from the middle part even when the plate is tilted, and can thus be made less likely to spill off the plate.

3 Claims, 7 Drawing Sheets

PLATE WITH INCLINED SURFACE

BACKGROUND OF THE INVENTION

Field of the Invention

The present invention relates to a plate formed to be inclined in a direction of an outer edge from a predetermined position on the upper surface.

Description of the Related Art

Heretofore, plates formed to be inclined from a predetermined position on the upper surface are known.

As this type of plate, a plate 101 in which a gently inclined surface 106 is formed in a food serving portion and a plurality of rows of grooves 102 are cut linearly in the inclined direction of the inclined surface 106 is known (refer to FIG. 7). Oily juices that run out of food placed on the serving portion of this plate 101 run into a recessed part 103 in the middle part after running along the inclined surface (refer to Japanese Application for Utility Model Registration No. 3043757).

Japanese Application for Utility Model Registration No. 3043757 is an example of related art.

However, with this conventional plate, oily juices from food placed on the upper part of the plate 101 run along the linearly cut grooves 102 when the plate 101 is tilted and thus tend to spill off the plate, and oily juices that have dripped off the plate getting on clothing and the like is a major problem in places such as restaurants. Another problem with the conventional plate 101 is that, in the case where oily juices run out from food onto the raised part of the inclined surface where there are no grooves 102, the oily juices run into the recessed part 103 in the middle part along the raised part of the inclined surface where there are no grooves 102, and thus the oily juices take time to run into the recessed part 103, and cannot be made to flow quickly into the recessed part 103 of the middle part.

SUMMARY OF THE INVENTION

The present invention has been made in view of the above problems, and an object thereof is to provide a plate from which oily juices are less likely to drip, and that is able to quickly collect oily juices from food at a predetermined location.

In order to solve the above problem and achieve the above object, a plate according to a first aspect of the present invention is a plate having an upper surface formed to be inclined downward in a direction of an outer edge from a predetermined position on the upper surface, the plate including a plurality of raised parts formed toward the direction of the outer edge from the predetermined position to curve in an outer peripheral direction, and an inclined surface formed between adjacent raised parts and inclined in a direction from an outer side part of the raised parts toward an inner side part of the adjacent raised part. Oily juices that run out of food toward the direction of the outer edge collide with the inner side part of the raised parts and converge with oily juices that run along the inner side part of the raised parts to flow out in the direction of the outer edge at an early stage.

According to the present invention, a plurality of raised parts are formed toward the direction of the outer edge from a predetermined position on the upper surface of the plate to curve in the outer peripheral direction, and thus oily juices from food on the plate run along the inner side part of the raised parts curved in the outer peripheral direction from the predetermined position even if the plate is tilted, and also accumulate in the dip in the raised parts, enabling oily juices to be made less likely to spill off the plate. In this way, oily juices can be made less likely to spill off the plate, thus enabling peace of mind to be enhanced in terms of oily juices being less likely to get on clothing and the like even when the plate is used in places such as restaurants. Also, a plurality of raised parts curved in the outer peripheral direction are formed toward the direction of the outer edge from a predetermined position on the upper surface of the plate, and an inclined surface formed between adjacent raised parts and inclined downward in a direction from the outer side part of the raised parts toward the inner side part of the adjacent raised part is formed, and thus oily juices that run toward the direction of the outer edge collide with the inner side part of the raised parts curved in the outer peripheral direction and converge with oily juices that run along the inner side part of the raised parts curved in the outer peripheral direction. The oily juices that converge with the oily juices that run along the inner side part of the raised parts run through oil channels formed by oily juices that previously ran along the inner side part of the raised parts, thus enabling the oily juices to flow out in the direction of the outer edge of the plate at an early stage.

A plate according to a second aspect of the present invention is the plate according to the first aspect, with the plurality of raised parts being formed equidistantly in a peripheral direction.

According to the present invention, a plurality of raised parts are formed substantially equidistantly in the peripheral direction, and thus the raised parts curved in the outer peripheral direction are formed toward the direction of the outer edge uniformly in the peripheral direction in a balanced manner, and the oily juices from food run uniformly along the raised parts curved in the outer peripheral direction, enabling the oily juices that run out of food to be efficiently collected at a predetermined location.

A plate according to a third aspect of the present invention is the plate according to the aspect of the first or second aspect, with the plate having a circular shape, and the predetermined position being a middle part of the circular shape.

According to the present invention, the predetermined position is a substantially middle part, and thus the raised parts curved in the outer peripheral direction can be formed of equal length, enabling the oily juices from food to run uniformly along the raised parts curved in the outer peripheral direction, and be less likely to spill off the plate. Also, because the predetermined position is a substantially middle part, the oily juices from food run along the inclined surface that is inclined in the direction of the outer edge from the substantially middle part, enabling the oily juices that run out of food to be efficiently collected at a predetermined location.

A plate according to a fourth aspect of the present invention is the plate according to the third aspect, with the raised parts being the same shape, and lines joining the middle part of the circular shape and an end point on the circumference side of the respective raised parts all intersecting the adjacent raised part.

According to the present invention, the raised parts are the same shape, and a line joining the middle part and an end point on the circumference side of the raised parts intersects the adjacent raised part, and thus when the oily juices from food on the plate run toward the direction of the outer edge of the plate, almost all of those oily juices that run toward the direction of the outer edge collide with the side part of the raised parts. Most of the oily juices can thereby be made to converge in the oil channels formed by oily juices that previously ran along the raised parts, and can be made to flow in the direction of the outer edge of the plate at an early stage.

A plate according to a fifth aspect of the present invention is the plate according to any one of the first to fourth aspects, with a difference between a lowest part and a highest part of the upper surface being 0.5 mm to 3.0 mm.

According to the present invention, even with a thin plate in which the difference between the lowest part and the highest part of the upper surface is 0.5 mm to 3.0 mm, oily juices can be made less likely to drip off the plate, and the oily juices that run out of food can also be quickly collected at a predetermined location.

According to a plate of the present invention, a plurality of raised parts curved in the outer peripheral direction are formed toward the direction of the outer edge from a predetermined position on the upper surface of the plate, and thus oily juices can be made less likely to drip off the plate, and the oily juices that run out of food can also be quickly collected at a predetermined location.

DESCRIPTION OF THE EMBODIMENTS

Figure 1:
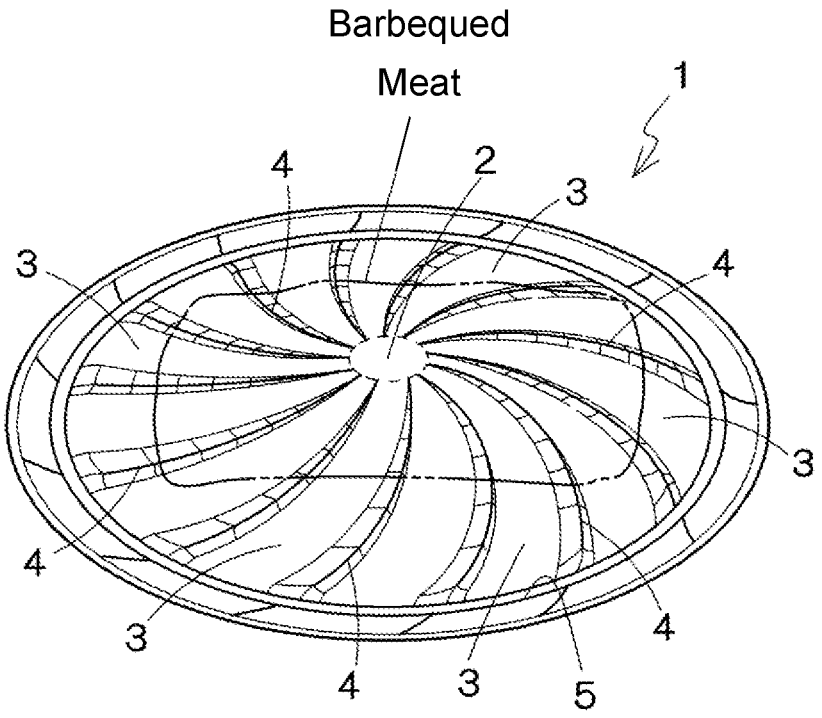
FIG. 1 is a perspective view of an upper part of a plate in one embodiment of the present invention.
Figure 2A:
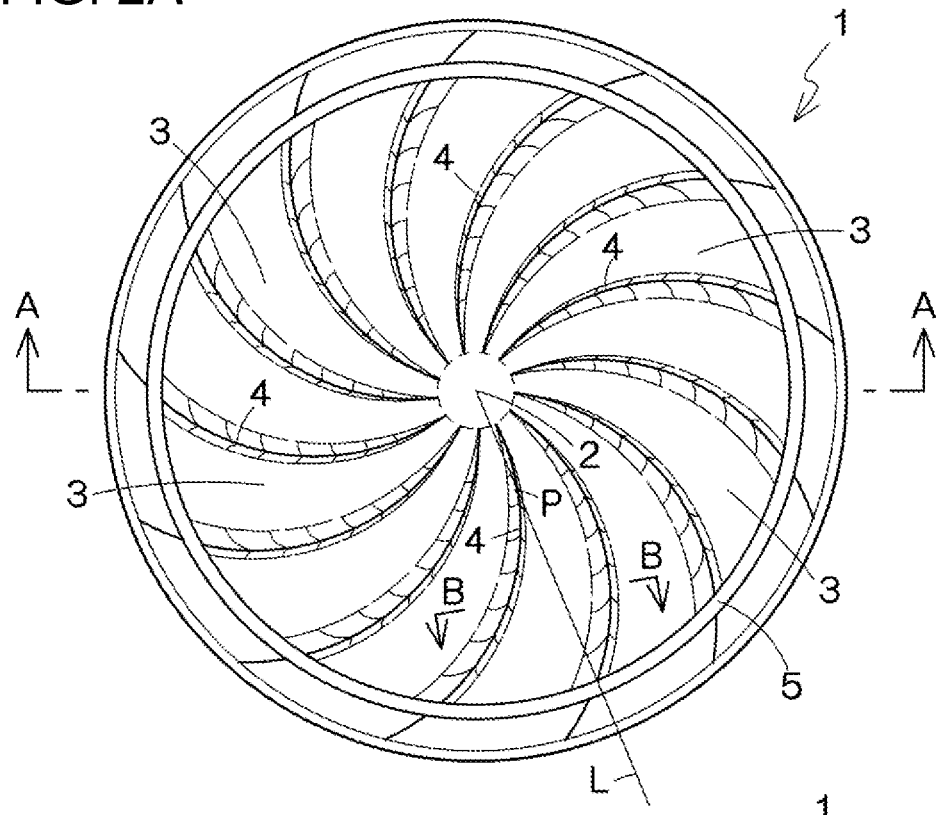
FIG. 2A is a plan view of the plate.
Figure 2B:
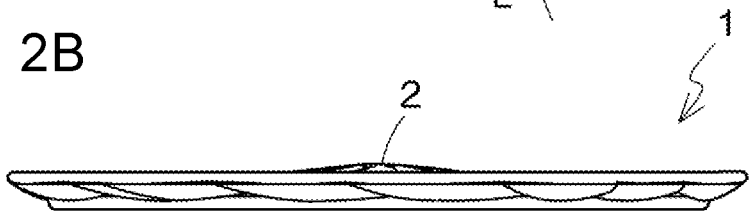
FIG. 2B is a side view of the plate.
Figure 2C:
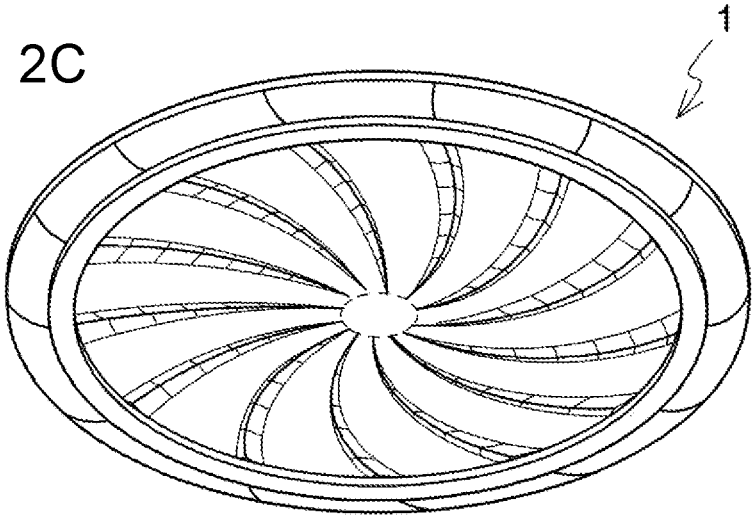
FIG. 2C is a perspective view of a lower part of the plate.
Figure 3A:
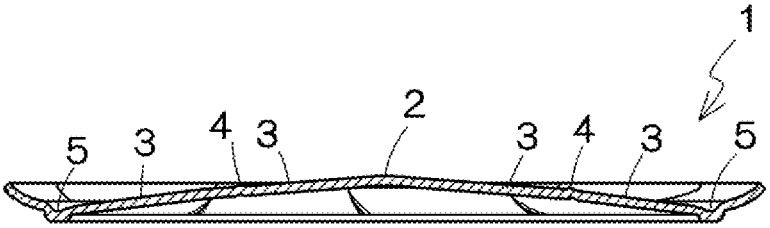
FIG. 3A is a cross-sectional view along A-A in FIG. 2A.
Figure 3B:
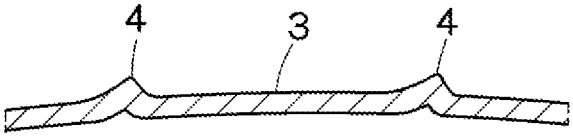
FIG. 3B is a cross-sectional view along B-B in FIG. 2A.

Hereinafter, one embodiment of a plate of the present invention will be described with reference to the drawings. Here, FIG. 1 is a perspective view of an upper part of the plate in one embodiment of the present invention, FIG. 2A is a plan view of the plate, FIG. 2B is a side view of the plate, FIG. 2C is a perspective view of a lower part of the plate, FIG. 3A is a cross-sectional view along A-A in FIG. 2A, and FIG. 3B is a cross-sectional view along B-B in FIG. 2A. Hereinafter, a mode will be described in which oily juices from food (barbequed meat, etc.) on a plate 1 run across the upper part of the plate 1.

As shown in FIGS. 1 and 3, the plate 1 is a thin plate having a substantially circular shape with the outer diameter being 25.0 cm and the difference between the lowest part and the highest part of the upper surface being 1.2 mm, and an inclined surface 3 that is inclined in the direction of the outer edge from a middle part 2 is formed on the upper surface. This inclined surface 3 is inclined at an angle of approximately 4.3 degrees from the middle part 2 to a substantially intermediate part, and at an angle of approximately 6.0 degrees from the substantially intermediate part to a substantially outer edge part. In this way, the angle of inclination in the direction of the outer edge becomes slightly steeper from the substantially intermediate part. Note that, in the present embodiment, the inclined surface 3 that is inclined in the direction of the outer edge from the middle part 2 on the upper surface is formed, but is not limited thereto, and may be an inclined surface that is inclined in the direction of the outer edge from a location on the left quarter or right quarter of the plate 1 other than the middle part 2, or may be an inclined surface that is inclined in the direction of the outer edge from a suitable predetermined position other than those locations, such as a substantially middle part of the upper surface of the plate 1. Also, in the present embodiment, the inclined surface is formed to be inclined at an angle in a range of approximately 4.3 to 6.0 degrees, but is not limited thereto, and may be formed to be inclined at an angle in a range of 4.0 to 6.5 degrees (preferably, in a range of 3.5 to 6.0 degrees). Also, in the present embodiment, the difference between the lowest part and the highest part of the upper surface of the plate 1 is given as 1.2 mm, but the present invention is not limited thereto, and the difference between the lowest part and the highest part of the upper surface of the plate 1 may be other than 1.2 mm, such as 0.5 to 3.0 mm (preferably 1.0 to 2.5 mm (more preferably 1.0 to 2.0 mm)). Furthermore, the outer shape of the plate 1 is given as being substantially circular, but may be another shape such as square.

Raised parts 4 are formed on the upper surface of the plate 1 toward the direction of the outer edge of the plate 1 from the middle part 2 of the plate 1. Thirteen raised parts 4 are formed substantially equidistantly in the circumferential direction, and are formed in a shape curved in an arch in the outer peripheral direction. Specifically, the raised parts 4 are formed to have a length from the middle part 2 of the plate 1 to the substantially outer edge part, a cross-sectional area that decreases in an upward direction, and a maximum width in a range of 10 to 15 mm (preferably 0.5 to 20 mm (more preferably 10 to 20 mm)) (refer to FIG. 3B). Here, "from the middle part 2 of the plate 1 to the substantially outer edge part" means from near the center of the plate 1 to near the outer edge, and, in the present embodiment, the raised parts 4 are formed at a length from a position slightly removed from the center of the plate 1 to just short of a groove 5 discussed later. Also, the raised parts 4 are all the same shape, and are formed such that a line L joining the start point (middle part 2) and end point (substantially outer edge part) of the raised parts 4 intersects the adjacent raised part 4 at a point of intersection P (refer to FIG. 2A). Here, the line L is a line joining the start point and end point of the raised parts 4, but, in FIG. 2A, has been extended further than the end point to improve visibility. Note that, in the present embodiment, the raised parts 4 are all formed in the same shape, but are not limited thereto, and may be different shapes. Also, in the present embodiment, the raised parts 4 are formed such that the line L joining the start point and end point of the raised parts 4 intersects the adjacent raised part 4 at the point of intersection P, but are not limited thereto, and may be formed such that the line L intersects the adjacent raised part 4 at a location that is at least half of the full length of the line L from the start point of the raised parts 4. Also, a groove 5 is formed in the outer edge part of the inclined surface 3 of the plate 1. This groove 5 has a depth of 2.0 mm, and is formed so as to enclose the inclined surface 3 of the plate. Also, in the present embodiment, thirteen raised parts 4 are formed, but the present invention is not limited thereto, and any plurality of raised parts 4 may be provided, such as thirteen or more, or four to twelve (preferably four to eight). Note that, in the present embodiment, the raised parts 4 are formed at a length from the middle part 2 of the plate 1 to the substantially outer edge part, but are not limited thereto, and may be formed at a length from the middle part 2 of the plate 1 to a position that is 0.7 to 0.98 times the radius of the plate 1 (preferably 0.75 to 0.95 times (more preferably 0.8 to 0.95 times)), or may be formed at a length from a position that is 0.3 times the radius from the center of the plate 1 to a position that is 0.98 times the radius (preferably, at least from a position that is 0.4 times the radius from the center to a position that is 0.9 times the radius (more preferably, at least from a position that is 0.5 times the radius from the center to a position that is 0.9 times the radius)).

Next, the process by which oily juices from food (barbequed meat, etc.) placed on the plate 1 run along the raised parts 4 will be described with reference to FIGS. 4A and 4B. Here, FIG. 4A is a diagram showing a state in which oily juices that run out of barbequed meat placed on the plate in one embodiment of the present invention have collected on the upper surface of the plate, and FIG. 4B is a diagram showing a state in which the oily juices from the barbequed meat placed on the plate run along the raised parts.

Figure 4A:
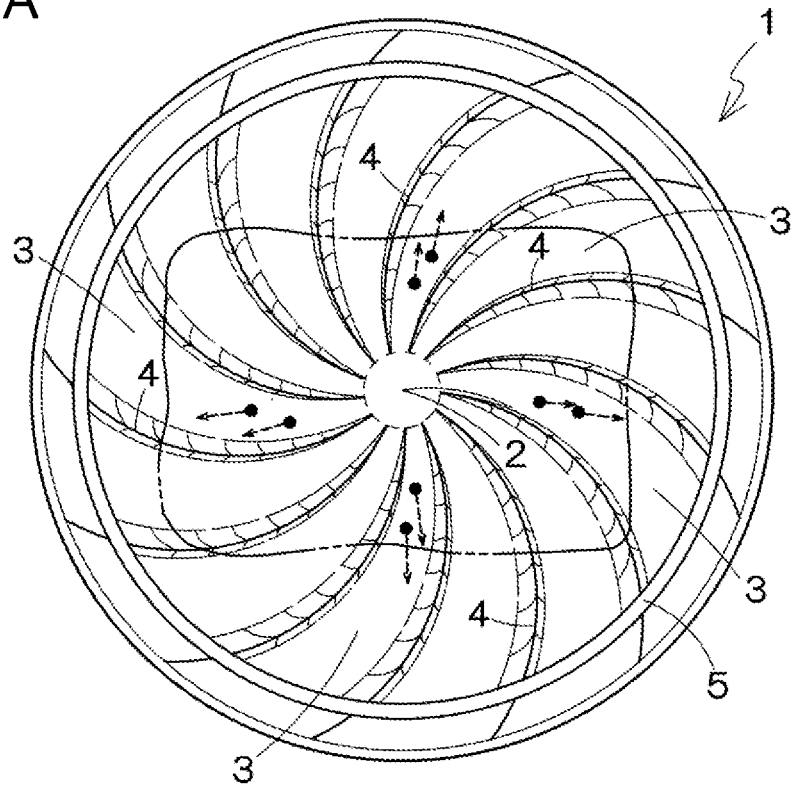
FIG. 4A is a diagram showing a state in which oily juices that run out of barbequed meat placed on the plate have collected on the upper surface of the plate.
Figure 4B:
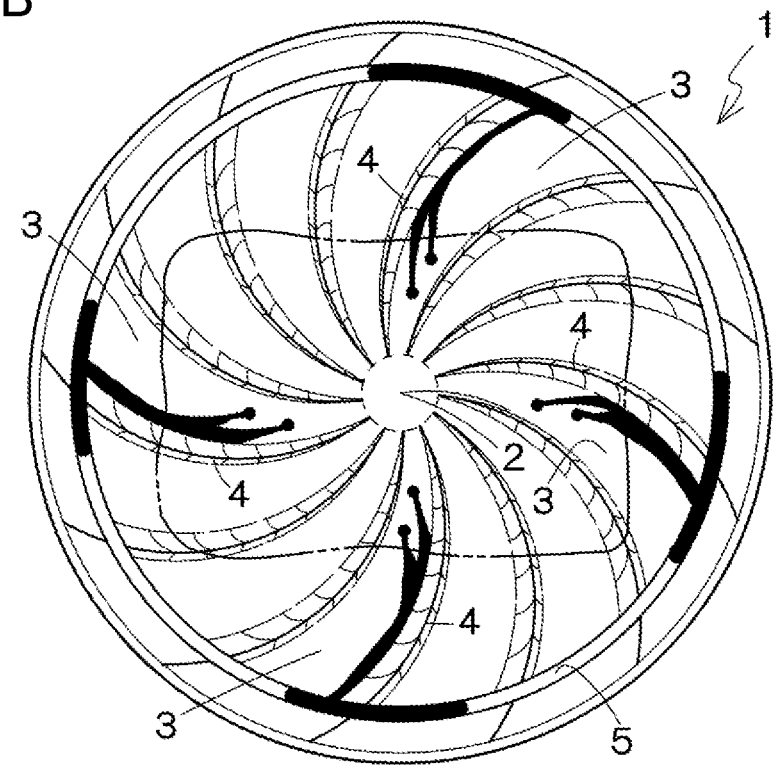
FIG. 4B is a diagram showing a state in which oily juices that run out of barbequed meat placed on the plate run along raised parts.

As shown in FIG. 4A, when oily juices run out from the barbequed meat placed on the plate 1, the oily juices run out from the underside of the barbequed meat between the raised parts 4 of the plate 1, and the oily juices that have run out become semicircular in shape due to interfacial tension and pool as oily globules (small globes of oily juices) on the upper surface of the plate 1.

The oily globules on the upper surface of the plate 1 subsequently collide over time with the oily juices that run out of the barbequed meat on the plate 1, resulting in the semicircular oily globules on the upper surface of the plate 1 breaking up and slowly running in the inclined surface direction of the plate 1, that is, in the direction of the outer edge from the middle part 2 of the plate 1 (refer to FIG. 4B). When the oily juices that run out of the semicircular oily globules run along the inclined surface in the direction of the outer edge from the middle part 2, these oily juices collide with the side part of the raised parts 4 curved in the outer peripheral direction, and converge with the oily juices that run along the raised parts 4 curved in the outer peripheral direction. These oily juices that converge with the oily juices that run along the raised parts 4 then run through oil channels formed by oily juices that previously ran along the raised parts 4, and can thus be made to flow out in the direction of the outer edge of the plate 1 at an early stage. Moreover, if the raised parts 4 are configured such that a line joining the start point (middle part 2) and end point (substantially outer edge part) of the raised parts 4 of the plate 1 intersects the adjacent raised part 4 at a location that is at least half of the full length of the line from the start point (middle part 2) of the raised parts 4, almost all of the oily juices that run in the inclined surface 3 direction collide with the side part of the raised parts 4 when the oily juices from the barbequed meat placed on the plate 1 run in the inclined surface 3 direction of the plate 1. This thereby enables most of the oily juices to converge in the oil channels formed by oily juices that previously ran along the raised parts 4, and to flow in the direction of the outer edge of the plate 1 at an early stage. Adopting this configuration enables the oily juices that run along the raised parts 4 of the plate 1 to run into the groove 5 and pool in the groove 5 at an early stage.

Next, the direction in which the oily juices on the upper surface of the plate 1 run when the plate 1 is tilted will be described with reference to FIG. 5. Here, FIG. 5 is a diagram showing a state in which oily juices run across the upper surface of the plate in one embodiment of the present invention when the plate is tilted.

Figure 5:
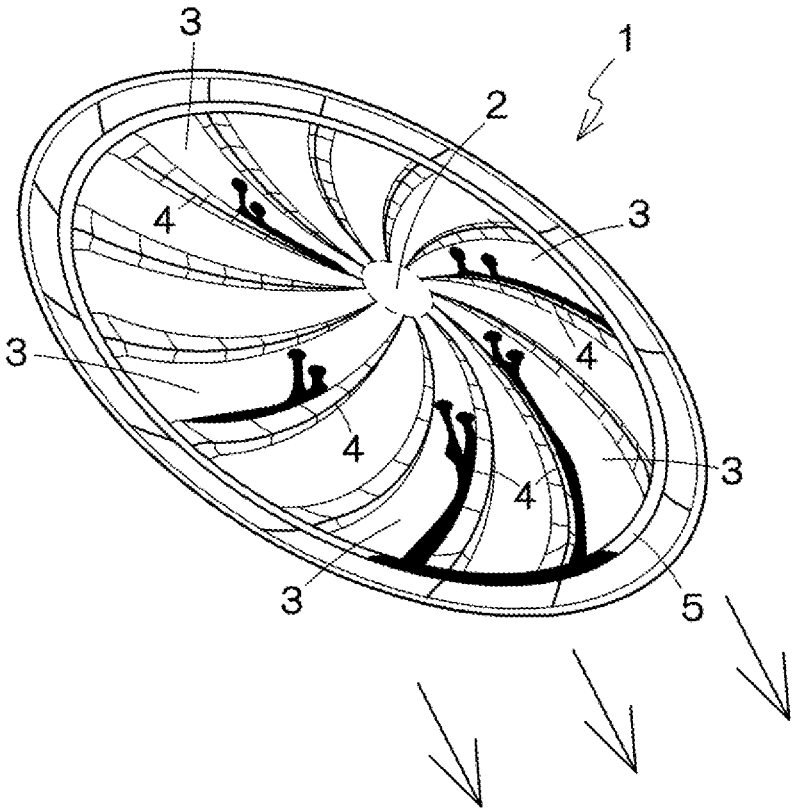
FIG. 5 is a diagram showing a state in which the plate is tilted and oily juices run across the upper surface of the plate.

As shown in FIG. 5, when the plate 1 on which oily juices that run out of barbequed meat has collected is tilted, the oily juices run off toward the direction in which the plate 1 is tilted. The oily juices that run off toward the direction in which the plate 1 is tilted collide with the side part of the raised parts 4, with the oily juices that collide with the dip in the raised parts 4 accumulating in the dip in the raised parts 4, and the oily juices that collide with the outer side of the curved part of the raised parts 4 running along the raised parts 4. In this way, oily juices can be made less likely to spill off the plate, as a result of the oily juices that collide in the dip in the raised parts 4 accumulating in the dip in the raised parts 4, and also as a result of the oily juices that run along the raised parts 4 running along the raised parts 4 that are shaped to curve in the outer peripheral direction. That is, because the raised parts 4 have a shape curved in the outer peripheral direction, long oil channels are formed along the raised parts compared with linear raised parts, and the time taken for the oily juices to run into the groove 5 can be lengthen.

According to the present embodiment, as described above, the raised parts 4 curved in the outer peripheral direction of the upper surface of the plate 1 are formed, and thus oily juices can be made less likely to spill off the plate, as a result of the oily juices from barbequed meat that collects on the plate 1 accumulating in the dip in the raised parts 4 even when the plate 1 is tilted, and also running along the raised parts 4 curved in the outer peripheral direction. In this way, because oily juices can be made less likely to spill off the plate 1, peace of mind can be enhanced in terms of oily juices being less likely to get on clothing and the like in places such as barbecue restaurants. Also, because the raised parts 4 curved in the outer peripheral direction of the upper surface of the plate 1 are formed, the oily juices that run toward the direction of the outer edge collide with the side part of the raised parts 4 curved in the outer peripheral direction, and converge with the oily juices that run along the raised parts 4 curved in the outer peripheral direction. These oily juices that converge with the oily juices that run along the raised parts 4 then run through oil channels formed by oily juices that previously ran along the raised parts 4, and can thus be made to flow out in the direction of the outer edge of the plate 1 at an early stage. The oily juices that run out of barbequed meat can thereby be quickly collected at a predetermined location.

The embodiment disclosed above should be considered as illustrative in all respects and not restrictive. The scope of the present invention is defined by the claims rather than the forgoing description, and all changes that come within the meaning and range of equivalency of the claims are intended to be embraced in the scope of the invention.

Figure 6A:
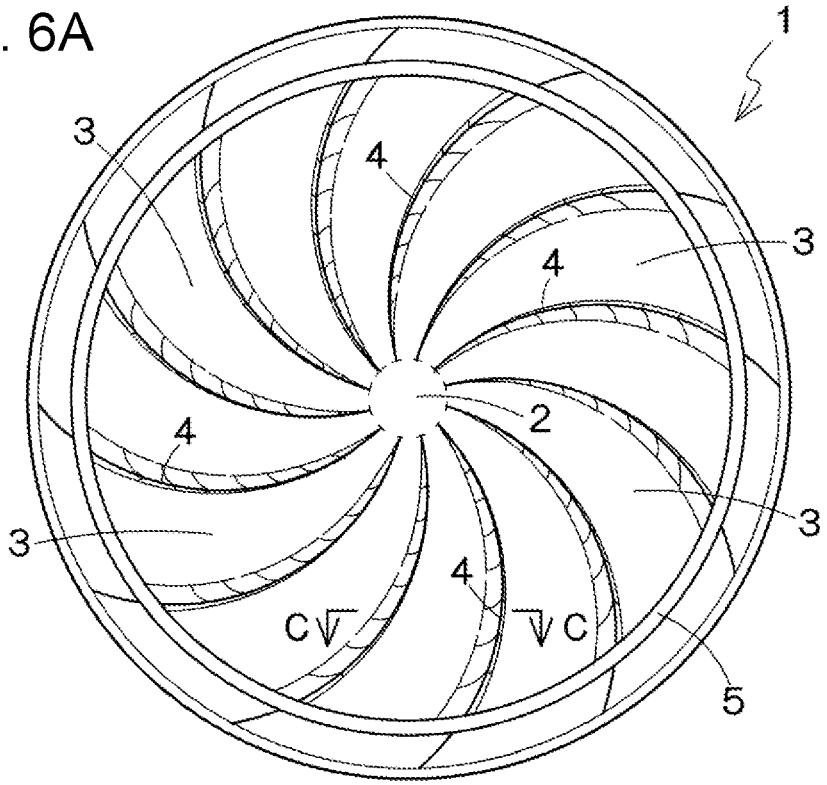
FIG. 6A is a diagram showing a plan view of a plate in a modification of the present invention.
Figure 6B:
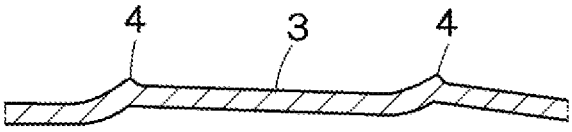
FIG. 6B is a cross-sectional view along C-C in FIG. 6A.
Figure 7:
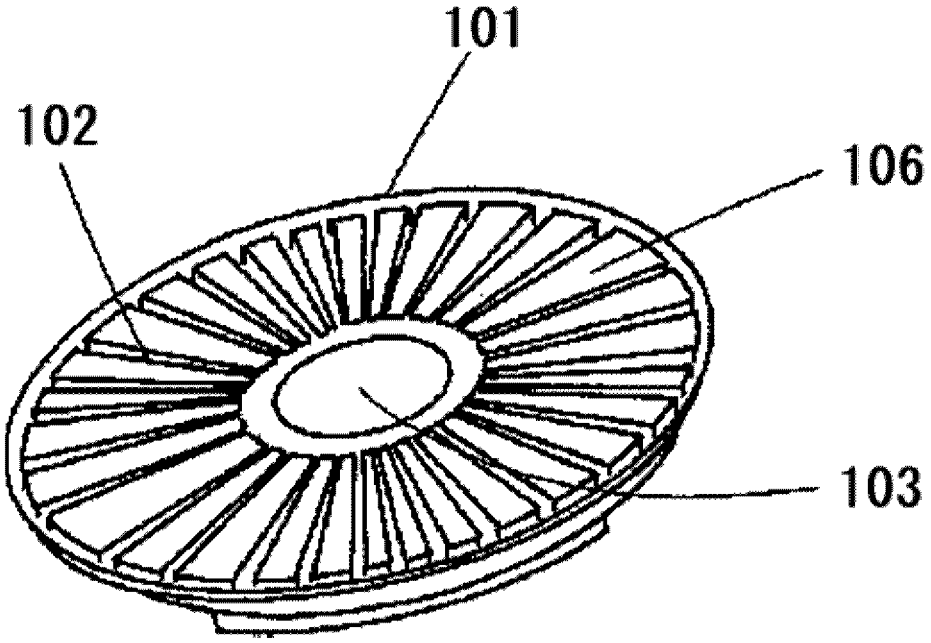
FIG. 7 is a diagram showing a conventional plate.

Hereinafter, a modification of the present invention will be described using FIGS. 6A and 6B. Here, FIG. 6A is a diagram showing a plan view of a plate in a modification of the present invention, and FIG. 6B is a cross-sectional view along C-C in FIG. 6A.

The present embodiment and the modification differ in that, in the present embodiment, the inclined surface is inclined from the middle part 2 of the plate 1 in the direction of the outer edge, whereas, in the modification, the inclined surface is further inclined in a direction from the raised parts 4 toward the raised parts 4. That is, a difference lies in the fact that the inclined surface between the raised parts 4 of the present embodiment is formed to be inclined downward at an angle of approximately 3.0 degrees in a direction from the outer side part of the raised parts 4 toward the inner side part of the raised parts 4, that is, in a direction that approximately intersects each region of the outer side part in the direction of the outer edge of the raised parts 4, in a direction from the outer side part of the raised parts 4 toward the inner side part. Note that, in this modification, the inclined surface is formed to be inclined downward at an angle of approximately 3.0 degrees in a direction that substantially intersects each region of the outer side part in the direction of the outer edge of the raised parts 4, in a direction from the outer side part of the raised parts 4 toward the inner side part, but is not limited thereto, and may be formed to be inclined downward at an angle from 1.0 to 4.0 degrees (preferably 1.0 to 3.0 degrees), or may be formed to be inclined downward in a direction from the outer side part of the raised parts 4 toward the inner side part at a predetermined angle. Also, in this modification, the inclined surface is formed to be inclined downward in a direction from the outer side part of the raised parts 4 toward the inner side part, but is not limited thereto, and may be formed to be inclined downward at an angle of approximately 3.0 degrees in a direction from the inner side part of the raised parts 4 toward the outer side part (the range of angles of inclination given above for this modification also similarly apply here).

In this way, the inclined surface is formed to be inclined downward in a direction from the outer side part of the raised parts 4 toward the inner side part, thus enabling oily juices that run toward the direction of the outer edge to be guided to collide with the inner side part of the adjacent raised part 4 at an early stage, and to flow out in the direction of the outer edge of the plate 1 at an early stage.

What is claimed is:

1. A circular plate having an upper surface formed to be inclined downward in a radial direction toward an outer edge of the circular plate from a center of the circular plate, the upper surface comprising:

a plurality of raised parts formed toward the radial direction to curve in a circumferential direction of the circular plate; and an inclined surface defining a space between adjacent raised parts in the circumferential direction and having a width in the circumferential direction greater than a width of each of the adjacent raised parts, the inclined surface being sloped downward in the circumferential direction from an outer side part of one of the adjacent raised parts to an inner side part of another one of the adjacent raised parts, so as to be inclined in two different directions including the radial direction and the circumferential direction, wherein oily juices that run out of food toward the radial direction collide with the inner side part of the another one of the adjacent raised parts and converge with oily juices that run along the inner side part of the another one of the adjacent raised parts to flow out in the direction of the outer edge at an early stage.

2. The plate according to claim 1, wherein the plurality of raised parts are formed equidistantly in the circumferential direction.

3. The plate according to claim 1, wherein the raised parts are the same shape, each of the raised parts having inner and outer end points in the radial direction, and straight lines, each of which joins the center of the circular plate and the outer end point of a respective one of the raised parts, each intersects a corresponding one of the raised parts adjacent to the respective one of the raised parts.

* * * * *